US006021842A

United States Patent [19]

Bülhoff et al.

[11] Patent Number: 6,021,842

[45] Date of Patent: Feb. 8, 2000

[54] ELECTROMAGNETIC DEVICE FOR USE WITH A CONTINUOUS-CASTING MOULD

[75] Inventors: Dieter Bülhoff, Düsseldorf; Wolfram Jung, Siegen; Hans-Joachim Paris, Düsseldorf; Otto-Alexander Schmidt, Krefeld, all of Germany

[73] Assignee: Mannesmann Aktiengesellschaft, Düsseldorf, Germany

[21] Appl. No.: 09/029,564

[22] PCT Filed: Aug. 13, 1996

[86] PCT No.: PCT/DE96/01554

§ 371 Date: Jun. 1, 1998

§ 102(e) Date: Jun. 1, 1998

[87] PCT Pub. No.: WO97/07911

PCT Pub. Date: Mar. 6, 1997

[30] Foreign Application Priority Data

Aug. 29, 1995 [DE] Germany ..... 195 33 577

[51] Int. Cl.[7] ..... B22D 27/02

[52] U.S. Cl. ..... 164/504; 164/468

[58] Field of Search ..... 164/466, 468, 164/502, 504

[56] References Cited

FOREIGN PATENT DOCUMENTS 2-75455 3/1990 Japan ..... 164/466

*Primary Examiner*—Kuang Y. Lin

*Attorney, Agent, or Firm*—Cohen, Pontani, Lieberman & Pavane

[57] ABSTRACT

A stationary continuous casting mold, especially for casting steel, with an electromagnetic device having a plurality of stirrer elements which are arranged in pairs on the outer wall of the continuous casting mold at a distance from one another and are connected to an electric a.c. voltage. The stirrer elements include at least two pairs and the stirrer elements of each pair are arranged opposite one another and so as to be rotated at an angle relative to one another in an X-shaped configuration in a plane parallel to the casting direction. All pairs are arranged at substantially the same height.

7 Claims, 3 Drawing Sheets

ELECTROMAGNETIC DEVICE FOR USE WITH A CONTINUOUS-CASTING MOULD

BACKGROUND OF THE INVENTION

1. Field of the Invention

The invention is directed to a stationary continuous casting mold, especially for casting steel, with an electromagnetic device having a plurality of stirrer elements which are arranged on the outer wall of the continuous casting mold at a distance from one another and are connected to an electric a.c. voltage in a corresponding phase position for generating a rotating electromagnetic force field.

2. Discussion of the Prior Art

Stationary continuous casting molds are suitable for carrying out the process of casting steel using the immersion pipe casting method, in which the immersion pipe extending into the continuous casting mold is immersed in the melt. It is known to influence the solidification in continuous casting of high-melting metals such as steel by generating rotating electromagnetic fields in the stationary continuous casting mold by means of stirring. A stirring device for stationary continuous casting molds with two component stirring devices which can be operated independent from one another and are arranged one behind the other in the casting direction on the outer wall of the continuous casting mold is known, for example, from German Reference DE-OS 38 19 492. For this purpose, the electromagnetic rotating fields are generated in the mold. This stirring device is intended, in particular, to achieve a uniform, finer microstructure of the cast strand, a uniform distribution of nonmetallic inclusions, an improved removal of heat, etc.

In order to generate the magnetic flux, the stirring device (Herrmann, E., "Handbuch des Stranggießens [Continuous Casting Handbook]", Aluminium-Verlag GmbH, Düsseldorf 1958, pages 417–429") can be constructed, for example, from a plurality of electromagnets of horseshoe-shaped transformer plates which are arranged vertically or horizontally on the wall of the continuous casting mold. The magnetic induction flux passes from one leg of the horseshoe to the other through the liquid metal melt. In so doing, the molten metal conducted through the mold is subjected to a continuous mechanical convection current by means of the magnetic flux. The stirring device is operated so that the electromagnets whose magnetic field propagates, for example, in the direction of the vertical axis of the mold are controlled such that the direction of maximum magnetic flux rotates about the vertical axis of the mold. In this way, a good circulation of the molten metal is achieved with good efficiency at the same time.

However, there are various disadvantages to stirring the melt with a stirring device of the type mentioned above. In spite of the stirring, there is usually ebullition at the surface of the melt which causes casting powder and slag particles at the immersion pipe to be drawn into the casting shell region. A further disadvantage consists in persistent bridging of solidified metal between the ceramic inlet tube and the mold wall in the upper region of the continuous casting mold despite stirring. In this type of stirring, there is also a recurring backup of superheat in the inner region of the mold, which promotes the formation of dendrites which then usually accumulate at the liquid-solid interface or solidification front of the melt as globulites. Although a uniform solidification front can be achieved with the known device, strips with negative segregation are formed in the melt.

SUMMARY OF THE INVENTION

It is the object of the present invention to provide an electromagnetic device for a stationary continuous casting mold in which the melt in the continuous casting mold is stirred in such a way that ebullition at the surface of the melt, bridging of solidified metal between the ceramic inlet pipe and the mold wall in the upper region of the continuous casting mold, and a building up of superheat in the inner region of the mold are prevented.

The invention provides that the electromagnetic device comprises at least two pairs of stirrer elements and the stirrer elements of each pair are arranged opposite one another, namely so as to be rotated at an angle relative to one another in an X-shaped configuration, wherein the rotation is carried out by each stirrer element of each pair in a plane parallel to the casting direction. All stirrer pairs are arranged at substantially the same height.

In this way, the flow speeds of the liquid metal which were originally vertically directed are reversed or at least sharply reduced in the region of the inlet pipe, wherein a layering of temperature in the case of an extensive reduction in vertical flow is prevented in that each of the component stirrer devices causes, in addition, a horizontal agitation of the liquid metal melt. Each of the electromagnetic devices leads to a spiral, upwardly directed rotational movement of the liquid metal melt in the central region of the mold, which causes superheated steel to be moved upward from the lower region of the mold, which in turn prevents a solidification of the melt between the ceramic inlet pipe and the mold wall (bridging, as it is called). The electromagnetic device according to the invention brings about a horizontal and vertical rotation of the melt. These rotating movements generated in the melt effectively prevent the formation of white strips (strips with negative segregation).

The electromagnetic device further leads to an improvement in the degree of purity of the cast strand because the reduction in vertical flows in the melt promotes a floating up of impurities in the slag zone.

In a stationary continuous casting mold with a rectangular cross section, also called a beam-bank cross section, it is advantageous to provide two pairs of stirrer elements, wherein the stirrer elements of the pairs are arranged opposite one another on the broad sides. Both pairs, independently from one another, generate a spiral, upwardly directed rotational movement in opposite rotational directions in the mold region located between them, wherein the flows of the molten steel in the stationary continuous casting mold influence one another in the region of the immersion pipe in such a way that a spiral, upwardly directed rotational movement of the melt also occurs around the immersion pipe.

The controlling of the stirrer elements in a stationary continuous casting mold with rectangular cross section with two pairs of stirrer elements is simplified when the stirrer elements of each pair are electrically connected in series to a.c. voltages which are out of phase by 90°.

The electromagnetic device according to the invention is especially effective when the angle by which the stirrer elements are rotated relative to one another in the casting direction is between 30° and 60°.

In an advantageous embodiment, the stirrer elements are constructed as coils with a ferromagnetic U-shaped core. In this way, a strong magnetic field can be generated in the stationary continuous casting mold in an economical manner.

Different casting conditions can be adapted to in a simple manner by providing an actuating drive by means of which the stirrer elements of every pair can be rotated relative to one another during operation. The electromagnetic device can accordingly be optimally adjusted with little effort. For this purpose, the stirrer elements are advisably supported in rotatable holders which can be adjusted by an actuating drive. The control is usually effected either by manual regulation or by means of a predetermined adjusting algorithm. For example, the frequency of ebullition at the surface of the melt can serve as a control variable; but the depth of the suction funnel of the metal melt forming at the immersion pipe can also be used.

An embodiment of a stationary continuous casting mold for the continuous casting of metals, especially steel, with an electromagnetic device according to the invention is described below with reference to the schematic drawing.

DETAILED DESCRIPTION OF THE PREFERRED EMBODIMENTS

Figure 1A:
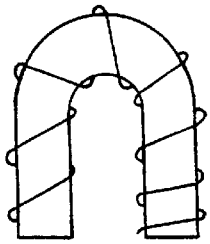
FIG. 1*a* shows a U-shape stirrer element
Figure 1:
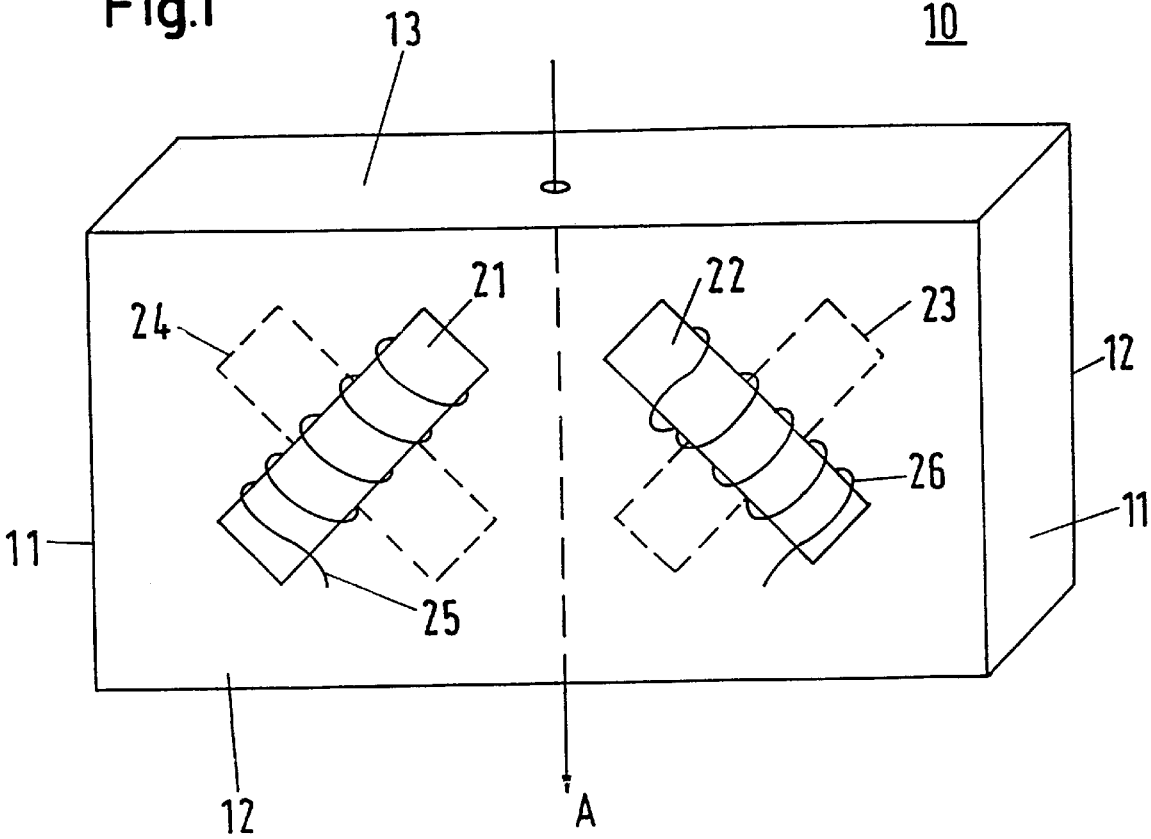
FIG. 1 shows a schematic three-dimensional view of a stationary continuous casting mold for the continuous casting of metals with an electromagnetic device according to the invention.

As is shown in FIG. 1, a stationary continuous casting mold 10 for continuous casting of metals has four metal mold walls 11, 12, namely two broad sides 12 and two narrow sides 11. The continuous casting mold 10 is open on the bottom and on the top; the lower cross-sectional surface through which the metal strand exits the mold is normally less than or equal to the upper cross-sectional surface of the continuous casting mold 10. The mold walls 11, 12 enclose a mold cavity 13 into which an immersion pipe 14 projects immersion pipe 14 has one or more outlet openings at its free end in the mold cavitiy 13. Molten metal which can be supplied continuously via the immersion pipe 14 is located in the mold cavity 13 and is continuously guided out through the lower mold outlet opening. The molten metal solidifies upon contact with the cooled mold walls 11, 12 of the continuous casting mold 10 so that a shell is formed. The thickness of this shell gradually increases as the metal passes through the continuous casting mold 10 until it exits the lower part of the continuous casting mold 10 as a strand. Since the strand is not completely solidified at this point, the shell of the strand must have a sufficient thickness when exiting the continuous casting mold 10 to retain the molten core which finally solidifies and forms a solid strand.

The meniscus or casting level forming in the mold cavity 13 lies above the outlet opening of the immersion pipe 14 and is covered with casting powder. The casting powder serves as a lubricant and reduces the friction between the outer surface of the melt and the mold walls 11, 12.

The continuous casting mold 10 is provided with an electromagnetic device 20 which is formed by stirrer elements 21–24 arranged on the mold walls 11, 12. The stirrer elements 21–24 are connected to form pairs 21, 24 and 22, 23. In the illustrated embodiment, two pairs 21, 24 and 22, 23 are arranged on the right-hand side and left-hand side in the casting direction A. The stirrer elements of each pair 21, 24 and 22, 23 are provided on the broad sides 12 of the continuous casting mold 10 so as to face one another. As can be seen in FIG. 1, the stirrer elements 21, 24 and 22, 23 of each pair are rotated at an angle to form an X in a plane parallel to the casting direction. The angle by which the stirrer elements of a pair are rotated relative to one another is preferably between 30° and 60°. In the illustrared embodiment, the stirrer elements of a pair are rotated by 45° relative to one another, i.e., the rotation of the stirrer elements of a pair is (2 times 45° equals) 90°. The exact angle is determined in a known manner by the phase relationship of the a.c. voltage which provides for the excitation of the stirrer elements 21–24. When the stirrer elements 21–24 are connected to a.c. voltages which differ by a phase difference of 45° in the sequence of the stirrer elements 21–24, as in the present embodiment, the angle by which the stirrer elements of a pair are arranged so as to be rotated relative to one another is 45°.

Each of the stirrer elements 21–24 can have a ferromagnetic U-shaped core (FIG. 1*a*). In the illustrated embodiment, the core is an iron core which is produced from dynamo sheet and carries coils of copper wire 25–28. The cross section of the cores is rectangular, and the pole shoes rest on the mold walls 11, 12. The generated magnetic fields of the stirrer elements 21–24 penetrate through the mold walls 11, 12 into the mold cavity 13 and penetrate the metal melt.

In accordance with the law of induction, a voltage is induced in the moving melt which is equal to the derivative of the magnetic flux with respect to time. Based on the Biot-Sarvart law, the electrical currents resulting from the induced voltage cause a force effect in the melt proportional to the vector product of induction and current. The force field induced by the magnetic field causes mechanical flows in the melt which cause the melt to be agitated.

Figure 3:
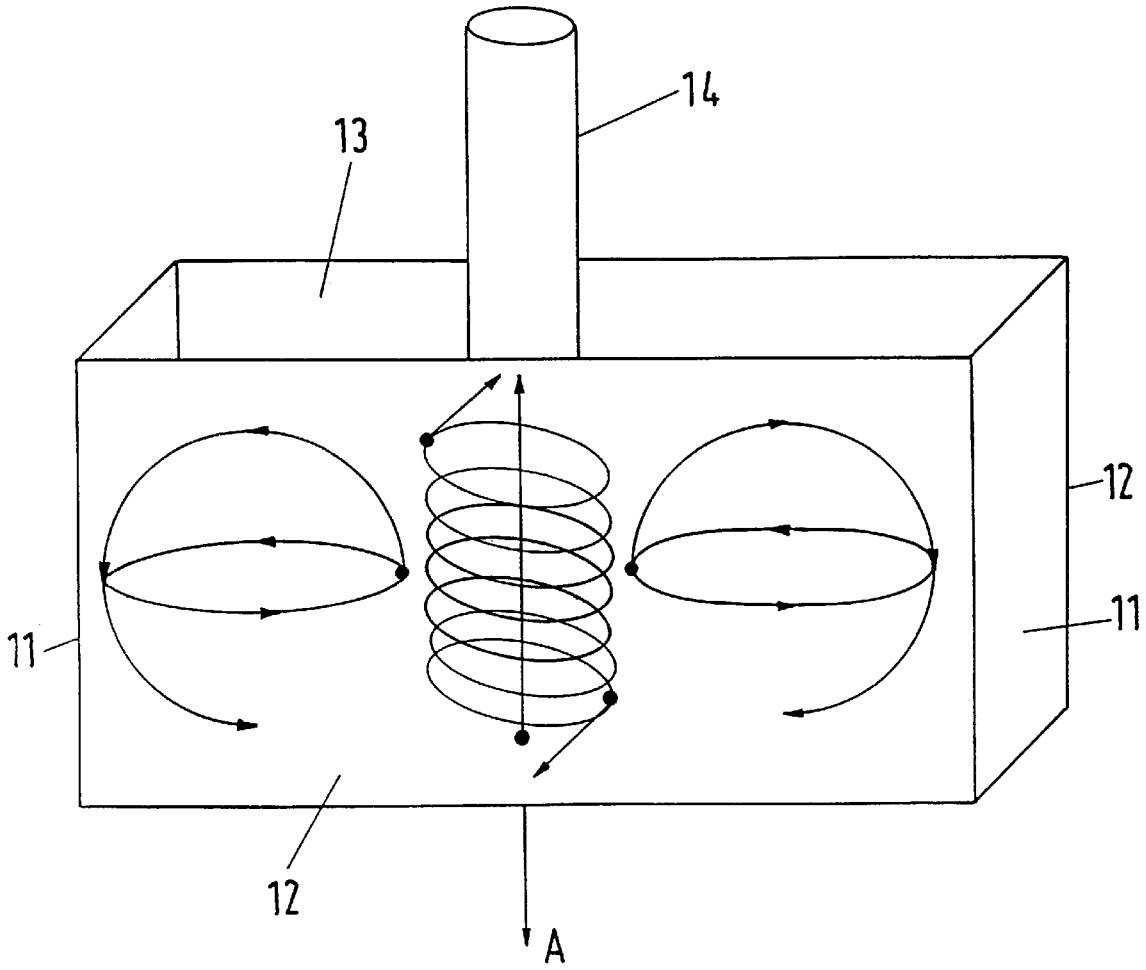
FIG. 3 shows a schematic three-dimensional view of a stationary continuous casting mold according to FIG. 1 with the mechanical force fields induced in the melt by the electromagnetic device according to the invention.

Every pair of stirrer elements 21, 24 and 22, 23 is operated so as to be independent from the other and is connected with respect to phase in such a way that a resulting magnetic rotating field is generated in the mold cavity 13 between the stirrer elements 21, 24 and 22, 23, which rotating field induces a rotating mechanical force field in the melt as is shown in FIG. 3. This rotating mechanical force field originates in the left half of the mold in the vicinity of the front broad side 12 and in the right half of the mold in the vicinity of the rear broad side 12. In each case, the rotating force field is directed upward, but toward the opposite mold wall, i.e., there are force components in the vertical direction as well as in the horizontal direction. Accordingly, oppositely directed force fields are induced in the left and right halves of the mold, so that a flow rotating from the middle toward the left-hand outer wall is generated in the melt in the left half of the mold and a flow rotating from the middle to the right-hand wall is generated in the melt in the right half of the mold. In the middle part of the mold, the vertical components of the force fields are directed upward; the horizontal vector components, however, run in opposite directions in both halves of the mold. The spacing between the pairs of stirrer elements 21, 24 and 22, 23 is selected in such a way that the melt carries out an agitating movement in the region of the immersion pipe without decelerating the melt which enters the mold through the immersion pipe while it is still in the immersion pipe. The electromagnetic braking action of the device 20 is definitely desirable outside of the immersion pipe.

In the central region of the mold, a continuous upward flow of hot melt is consequently generated by the pairs of stirrer elements 21, 24 and 22, 23; in so doing, an upwardly directed spiral rotational movement is compelled in the melt. This is directed opposite to the natural movement direction of the melt in the mold cavity 13, so that an at least partial suppression of the natural movement of the melt is brought about within the mold cavity 13 and the consequent ebullition at the surface with the disadvantageous inclusion of casting powder and slag particles in the strand shell region is prevented.

The electromagnetic device 20 enables a reversal of the vertical flow directions in the stationary continuous casting mold with the above-mentioned advantages with simultaneous horizontal agitation of the melt.

The simultaneous horizontal agitation in the left-hand and right-hand portions of the mold counteracts a temperature layering which simultaneously reduces the superheating. Developing dendrites which accumulate as globulites at the solidification front of the melt are eliminated by agitation. As a result of the horizontal and vertical agitation of the melt, the formation of negative segregations (also called white strips) is prevented.

Figure 2:
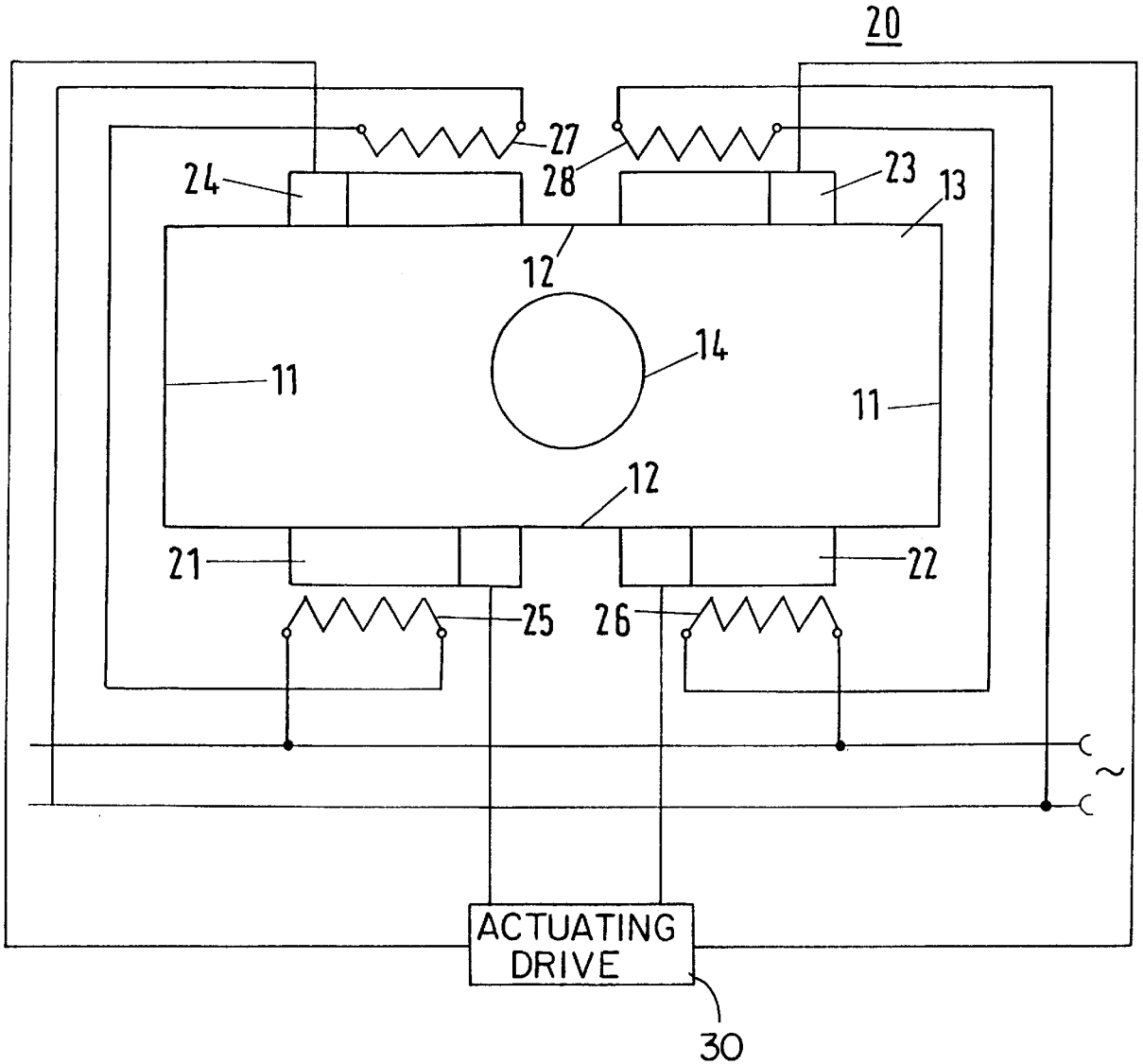
FIG. 2 is a top view of the stationary continuous casting mold shown in FIG. 1 with the connection diagram of the stirrer elements of the electromagnetic device connected to an a.c. voltage source.

FIG. 2 shows a top view of the stationary continuous casting mold shown in FIG. 1. In addition, the connection diagram of the stirrer elements 21–24 of the electromagnetic device 20 is shown. As can be seen in FIG. 2, the pairs 21, 24 and 22, 23 of the electromagnetic device 20 are electrically connected in series. Thus, the upper connections of the coils 25, 27 and 26, 28 are interconnected. The stirrer elements of a pair 21, 24 and 22, 23 can be operated at a standard a.c. voltage source as a result of the series connection.

Of course, the same effect can also be achieved by polyphase rotary currents at a phase displacement of 120° when a corresponding asymmetric three-dimensional arrangement of the pairs of stirrer elements 21, 24 and 22, 23 is used.

In order to adapt to different casting conditions, an actuating drive 30 is provided, by means of which actuating drive the stirrer elements of every pair 21, 24 and 22, 23 can be rotated in a predetermined manner relative to one another during operation in order to effect an optimum adjustment of the electromagnetic device 20. For this purpose, the stirrer elements 21, 24 and 22, 23 are advisably supported in rotatable holders which can be displaced by the actuating drive. The control is normally carried out by a microprocessor, either by manual regulation or with the help of a predetermined adjusting algorithm. The frequency of the ebullition at the surface of the melt can be used as a control variable; but the depth of the suction funnel of the metal melt forming at the immersion pipe can also be used.

Naturally, the electromagnetic device 20 can also be constructed from a plurality of pairs of stirrer elements 21, 24 and 22, 23, each of which generates, in the portion of the stationary continuous casting mold, the appropriate magnetic rotating fields described above with the corresponding rotating directions which can be adjusted by controlling the pairs of stirrer elements in correct phase and by a corresponding angular rotation of the stirrer elements of a pair 21, 24 and 22, 23 relative to one another.

We claim:

1. A stationary continuous casting mold, comprising:

an outer wall;

an electromagnetic device having a plurality of stirrer elements arranged in at least two pairs on the outer wall at a distance from one another; and an electric a.c. voltage connected to the pairs of stirrer elements in a corresponding phase position for generating a rotating electromagnetic force field, the stirrer elements of each pair being arranged opposite one another and so as to be rotated at an angle relative to one another in an X-shaped configuration in a plane parallel to a casting direction, all the pairs of stirrer elements being arranged at substantially a common height.

2. A continuous casting mold according to claim 1, wherein the outer wall is configured to define a continuous casting mold with a rectangular cross-section, the stirrer elements of the pairs being arranged opposite one another on broad sides of the rectangular cross-section.

3. A continuous casting mold according to claim 1, wherein the stirrer elements of each pair are electrically connected in series.

4. A continuous casting mold according to claim 3, wherein each of the stirrer elements which are electrically connected in series are connected to a.c. voltages which are out of phase by 90°.

5. A continuous casting mold according to claim 1, wherein the angle by which the stirrer elements are rotated relative to one another is between 30° and 60°.

6. A continuous casting mold according to claim 1, wherein the stirrer elements are coils with a ferromagnetic U-shaped core.

7. A continuous casting mold according to claim 1, and further comprising actuating drive means for rotating the stirrer elements of every pair relative to one another in a predetermined manner.

* * * * *